US009273636B2

(12) United States Patent
Zuo et al.

(10) Patent No.: US 9,273,636 B2
(45) Date of Patent: Mar. 1, 2016

(54) AUTOMATIC CONTROL APPARATUS FOR CARBURETOR CHOKE VALVE

(75) Inventors: Zongshen Zuo, Chongqing (CN); Yichao Wang, Chongqing (CN); Huarong Li, Chongqing (CN); Junjie Pei, Chongqing (CN); Bin Yuan, Chongqing (CN)

(73) Assignee: Chongqing Zongshen General Power Machine Co., Ltd. (CN)

( * ) Notice: Subject to any disclaimer, the term of this patent is extended or adjusted under 35 U.S.C. 154(b) by 816 days.

(21) Appl. No.: 13/582,497

(22) PCT Filed: Aug. 23, 2011

(86) PCT No.: PCT/CN2011/078748

§ 371 (c)(1),
(2), (4) Date: Sep. 4, 2012

(87) PCT Pub. No.: WO2012/028063

PCT Pub. Date: Mar. 8, 2012

(65) Prior Publication Data

US 2013/0000586 A1 Jan. 3, 2013

(30) Foreign Application Priority Data

Sep. 3, 2010 (CN) ..... 2010 2 0515423 U

(51) Int. Cl.
*F02M 1/08* (2006.01)
*F02M 1/10* (2006.01)

(52) U.S. Cl.
CPC .. *F02M 1/08* (2013.01); *F02M 1/10* (2013.01)

(58) Field of Classification Search
CPC ..... F02M 1/00; F02M 1/08; F02M 1/10
USPC ..... 261/38, 39.1, 39.3, 39.4; 236/92 D, 92 R
See application file for complete search history.

(56) References Cited

U.S. PATENT DOCUMENTS 2,998,233 A * 8/1961 Marsee ..... 261/39.3
3,321,193 A * 5/1967 Highley ..... 261/39.3

FOREIGN PATENT DOCUMENTS

| | | | |
|---|---|---|---|
| CN | 1740544 | A | 3/2006 |
| CN | 201031743 | Y | 3/2008 |
| CN | 201747476 | U | 2/2011 |
| DE | 3221563 | A1 | 12/1983 |
| JP | 2011856 | A | 1/1990 |

OTHER PUBLICATIONS

International Search Report for Application No. PCT/CN2011/078748 dated Dec. 1, 2011.

* cited by examiner

*Primary Examiner* — Robert A Hopkins
(74) *Attorney, Agent, or Firm* — Lerner, David, Littenberg, Krumholz & Mentlik, LLP

(57) ABSTRACT

An automatic control apparatus for a carburetor choke valve includes a pull-rod, throttle control lever, choke block, and temperature control assembly which is arranged on a cylinder head through a bracket having a rotating shaft and coil spring. The rotating shaft is connected to the spring and one end of the pull-rod via a rotary arm. The other end of the pull-rod is located at a choke valve shaft. The block and valve shaft are connected to respective ends of the lever. During cold start, the block is opened driving the lever to pull the valve shaft. When rotated through a certain angle the valve shaft is blocked by part of the pull-rod, such that the valve and block cannot be fully opened. During warm start, the valve shaft when returning is blocked by another part of the pull-rod such that the valve cannot fully close.

17 Claims, 7 Drawing Sheets

AUTOMATIC CONTROL APPARATUS FOR CARBURETOR CHOKE VALVE

CROSS-REFERENCE TO RELATED APPLICATIONS

The present application is a national phase entry under 35 U.S.C. §371 of International Application No. PCT/CN2011/078748 filed Aug. 23, 2011, published in Chinese, which claims priority from Chinese Patent Application No. 201020515423.4 filed Sep. 3, 2010, all of which are incorporated herein by reference.

FIELD

The present utility model relates generally to a carburetor choke valve control system and, more particularly, to an automatic control apparatus for a carburetor choke valve.

BACKGROUND

At present, carburetor choke valves are primarily divided into two kinds—automatic and manual. Under natural conditions, a carburetor choke valve in the automatic mode is fully closed, and after engine startup the choke block is driven to rapidly rotate by the forced air generated by the rotation of flywheel blades and the throttle control lever is driven by the choke block, causing the rotation of the carburetor choke valve shaft to open the choke valve. However, due to the high rotational speed of the flywheel and the rapid increase of the driving force of the forced air generated after engine startup, the choke valve is immediately opened to the maximum, thus resulting in a lower concentration of mixed gas entering the carburetor, and starting the engine smoothly becomes difficult and a hunting phenomenon emerges. In addition to that, as a mixed gas concentration on the low side is required when the engine is warm started and a conventional choke valve is still fully closed when being manually started a mixed gas concentration on the high side will make starting the engine difficult. In the manual mode, manual control of the extent of opening of the choke valve is required and this causes operation inconvenience.

SUMMARY OF THE UTILITY MODEL

The present utility model is aimed to provide an automatic control apparatus for a carburetor choke valve capable of automatically controlling the extent of opening of a carburetor choke valve.

The objective of the present utility model is realized by an automatic control apparatus for a carburetor choke valve, characterized in that the apparatus comprises a temperature control assembly, a pull-rod, a throttle control lever and a choke block, wherein the temperature control assembly is disposed on a cylinder head by means of a bracket, with the bracket being provided with a rotating shaft and a coil spring connected to the rotating shaft; the rotating shaft is connected to one end of the pull-rod via a rotary arm, the other end of the pull-rod is located at a choke valve shaft, and one end of the throttle control lever is connected to the choke block while the other end thereof is connected to the choke valve shaft. When the engine is cold started, the choke block is opened driving the throttle control lever to pull the choke valve shaft; when rotated through a certain angle the choke valve shaft will be blocked by a first position-limiting rod at location "a" of the pull-rod, such that the choke valve and the choke block cannot be fully opened; and when the engine is warm started, the choke valve shaft will be blocked by a second position-limiting rod at location "b" of the pull-rod when returning, such that the choke valve cannot be fully closed.

When the engine is cold started, the choke block is driven to rapidly rotate by the forced air generated by the rotation of flywheel blades and the throttle control lever is driven by the choke block, causing the rotation of the carburetor choke valve shaft to open the choke valve, during which time the engine is at a relatively low temperature and the temperature control apparatus is under natural conditions, and when rotated through a certain angle the choke valve shaft will be blocked by location "a" of the pull-rod such that the choke valve and the choke block cannot be fully opened, and the cooling air is blocked by the partially opened choke block and only a portion of the cooling air is allowed to take part in the cooling process thus reducing the warm-up time of the engine, and as the temperature of the cylinder head is gradually increased when the engine runs, the coil spring is rapidly heated and expanded causing the rotating shaft to rotate and thereby driving the rotary arm to swing, and with the rotary arm pulling the pull-rod the choke valve shaft is slowly rotated causing the choke valve to open fully; and when the engine is warm started after engine shutdown, the choke valve shaft will be blocked by location "b" of the pull-rod when returning such that the choke valve cannot be fully closed, and more fresh air is allowed to enter the combustion chamber, thus preventing excessive supply of fuel into the engine cylinder (the engine will become un-ignitable when excessive fuel is admitted into the engine cylinder) and facilitating warm start.

In order to better control the extent of opening of the carburetor choke valve, the pull-rod has a retaining bracket disposed thereon to limit the movement distance and direction of the pull-rod, wherein the retaining bracket is connected to the pull-rod via a circular hole and limits the movement distance and prevents the rotation of the pull-rod by means of a straight slot thereof and a protruding portion of the pull-rod. The circular hole and the straight slot on the retaining bracket play a favorable role in limiting the position and preventing the rotation of the pull-rod, and the location and length of the straight slot can effectively regulate the extent of opening of the choke valve during cold start and warm start of the engine. When immediate engine startup is not required, once the engine has cooled down the coil spring automatically returns and simultaneously causes the rotary arm to pull the pull-rod to move causing the choke valve shaft to turn around, and the choke valve becomes fully closed to facilitate cold start.

In order to prevent direct flow of forced air generated by the flywheel on the external shell that will affect the heating of the coil spring, the temperature control assembly is disposed behind a thermal insulation pad.

The straight slot is located at the bottom of the retaining bracket; the axis of the circular hole and that of the straight slot are coplanar, and the circular hole is located above the straight slot; the pull-rod has a U-shaped bend formed at the central portion thereof with the lower end of the U-shaped bend extending into the straight slot and the horizontal portion of the pull-rod penetrating through the circular hole.

One end of the pull-rod disposed at the choke valve shaft forms a P or F shape, the choke valve shaft having a position-limiting end located between the first position-limiting rod and the second position-limiting rod.

In order not to the full opening of the choke valve, a clearance is kept between the first position-limiting rod and the position-limiting end of the choke valve shaft when the first position-limiting rod is at the utmost left position.

The present utility model has the following advantages: through the provision of a temperature control assembly and a pull-rod limiting the angle of rotation of the choke valve shaft and the use of the temperature changes of the cylinder head, the utility model is capable of effectively controlling the extent of opening of the choke valve and ensuring that the choke valve can be opened only to a certain angle in a short period of time after a cold start of the engine and fully opened as the engine temperature rises; and when the engine is warm started, the choke valve remains opened at a certain angle and becomes fully opened under the action of the air control system after engine startup, thus significantly enhancing the startup performance of the engine.

DETAILED DESCRIPTION

Figure 1:
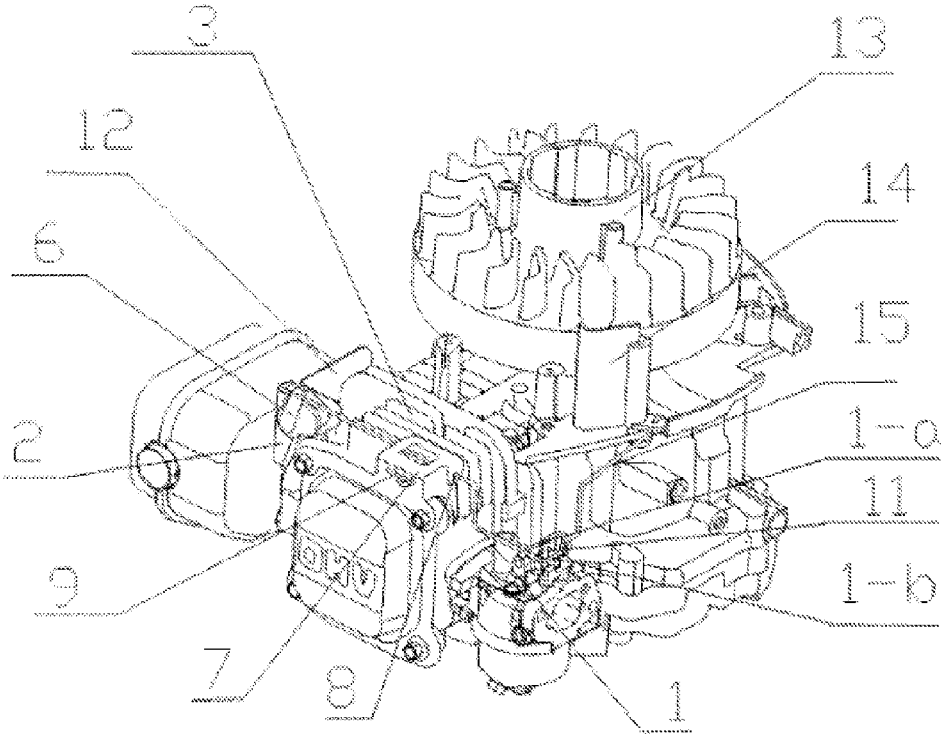
FIG. 1 is an isometric assembly view of an engine showing the embodiment of the present utility model.
Figure 2:
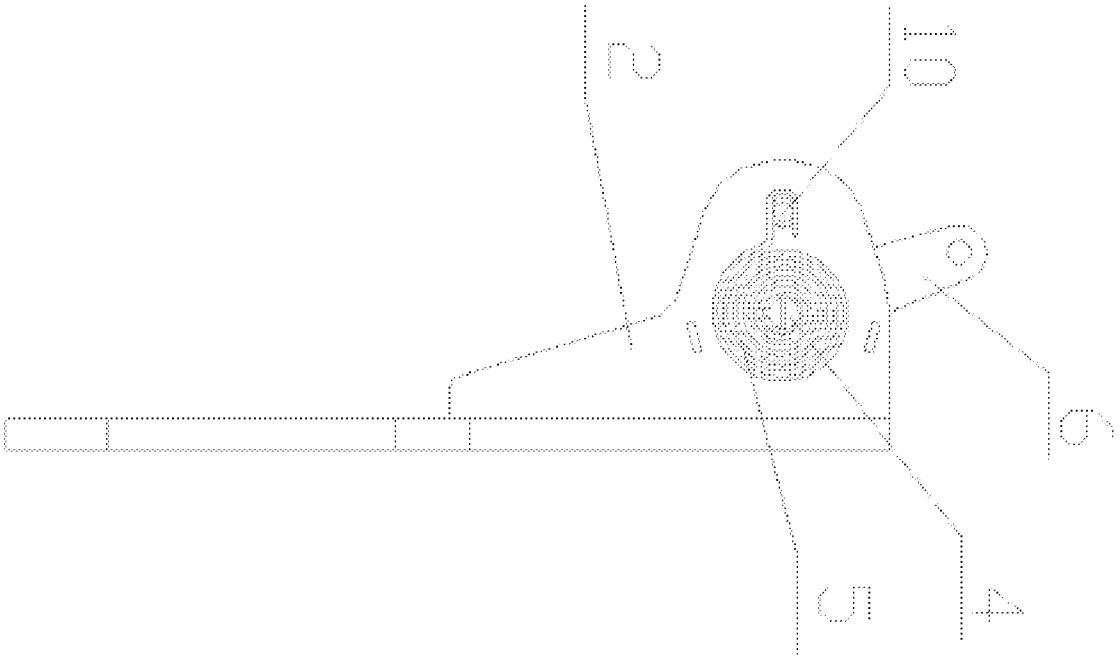
FIG. 2 is a schematic diagram showing the temperature control assembly of the present utility model.
Figure 3:
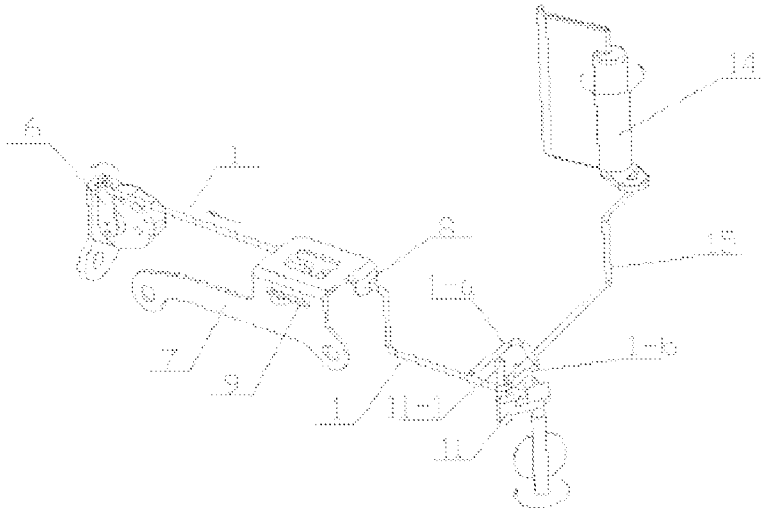
FIG. 3 is an isometric view showing the embodiment of the present utility model.
Figure 4:
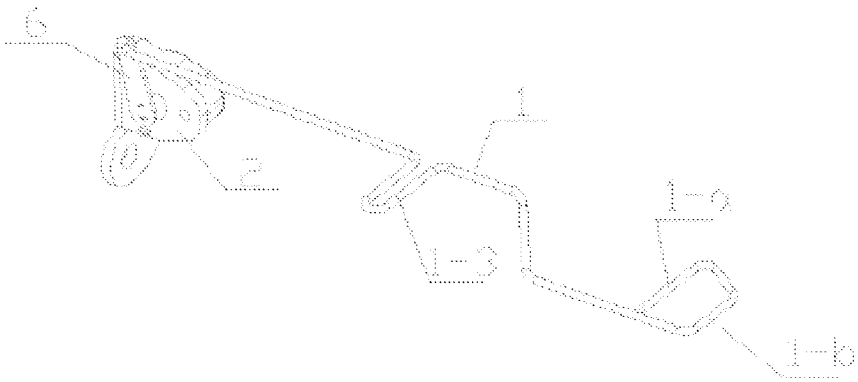
FIG. 4 is a schematic diagram showing the temperature control assembly and the pull-rod of the present utility model.
Figure 5:
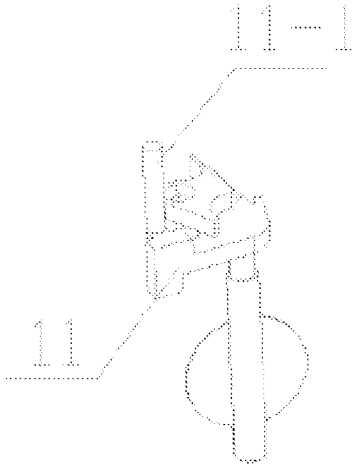
FIG. 5 is an isometric view showing the choke valve shaft of the present utility model.

FIGS. 1-5 illustrate an automatic control apparatus for a carburetor choke valve comprising a temperature control assembly, a pull-rod (1), a retaining bracket (7), a throttle control lever (15) and a choke block (14), wherein the temperature control assembly is disposed on a cylinder head (3) by means of a bracket (2), with the bracket (2) being provided with a rotating shaft (4) and a coil spring (5) connected to the rotating shaft (4); the rotating shaft (4) is connected to one end of the pull-rod (1) via a rotary arm (6), the other end of the pull-rod (1) is located at a choke valve shaft (11), and one end of the throttle control lever (15) is connected to the choke block (14) while the other end thereof is connected to the choke valve shaft (11); the pull rod (1) has a retaining bracket (7) disposed thereon to limit the movement distance and direction of the pull-rod (1), wherein the retaining bracket (7) limits the position and prevents the rotation of the pull-rod (1) by means of a circular hole (8) and a straight slot (9) thereof.

The straight slot (9) is located at the bottom of the retaining bracket (7); the axis of the circular hole (8) and that of the straight slot (9) are coplanar, and the circular hole (8) is located above the straight slot (9); the pull-rod (1) has a U-shaped bend (1-3) formed at the central portion thereof with the lower end of the U-shaped bend (1-3) extending into the straight slot (9) and the horizontal portion of the pull-rod (1) penetrating through the circular hole (8).

One end of the pull-rod (1) disposed at the choke valve shaft (11) forms a P shape, the choke valve shaft (11) having a position-limiting end (11-1) located between the first position-limiting rod (I-a) and the second position-limiting rod (I-b).

The coil spring (5) is installed in a slot disposed on the bracket (2) and one end of which is fixed to a positioning pin (10).

The coil spring (5) has a shell disposed thereon.

The temperature control assembly is disposed behind a thermal insulation pad (12).

Figure 6:
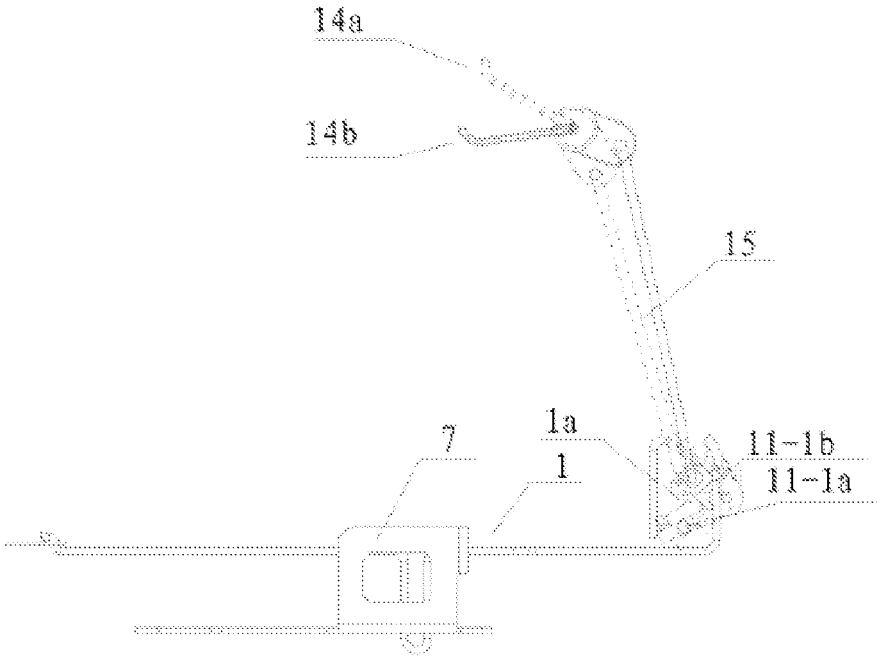
FIG. 6 is a schematic plan showing the positions of certain spare parts when the engine is cold started.
Figure 7:
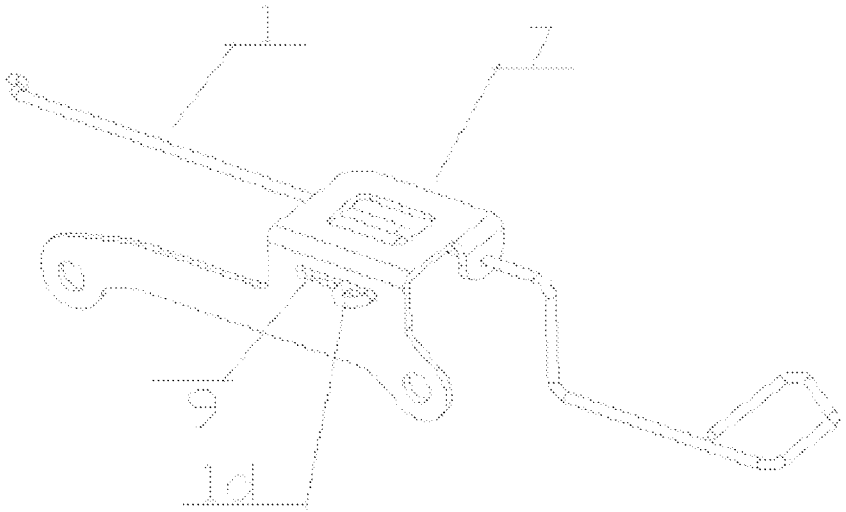
FIG. 7 is a schematic diagram showing the position of the bend (1-3) of the pull-rod in the straight slot when the engine is cold started.
Figure 10:
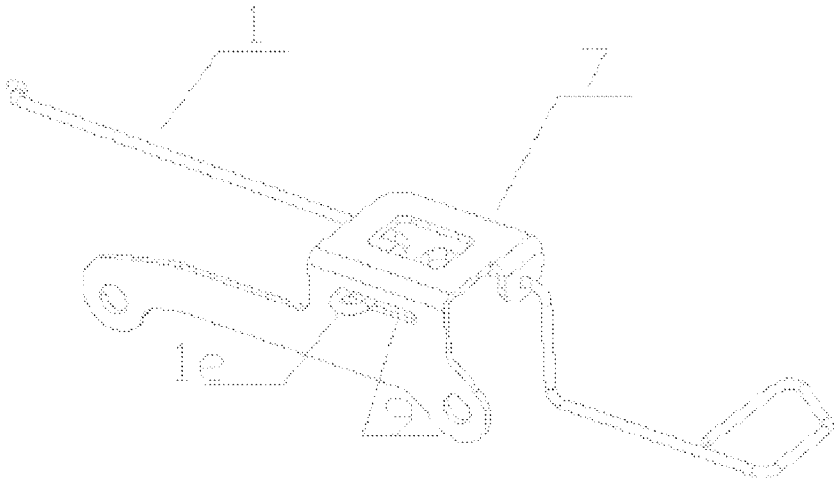
FIG. 10 is schematic diagram showing the position of the pull-rod in the straight slot when the choke valve is fully opened.

As shown in FIGS. 6, 7 and 10, before the engine is cold started the choke block (14) is located at 14*a*, the position-limiting end (11-1) of the choke valve shaft is located at 11-1*a*, and the first position-limiting rod (I-a) of the pull-rod is located at 1*a* and on the extreme right side 1*d* of the straight slot (9).

When the engine is cold started, the choke block (14) is driven to rapidly rotate by the forced air generated by the rotation of flywheel blades (13) and the throttle control lever (15) is driven by the choke block (14), causing the rotation of the carburetor choke valve shaft (11) to open the choke valve, during which time the engine is at a relatively low temperature and the temperature control assembly is under natural conditions, and when rotated through a certain angle the choke valve shaft (11) will be blocked by a first position-limiting rod (I-a) at location "a" of the pull-rod (1), such that the choke valve and the choke block (14) cannot be fully opened.

Figure 8:
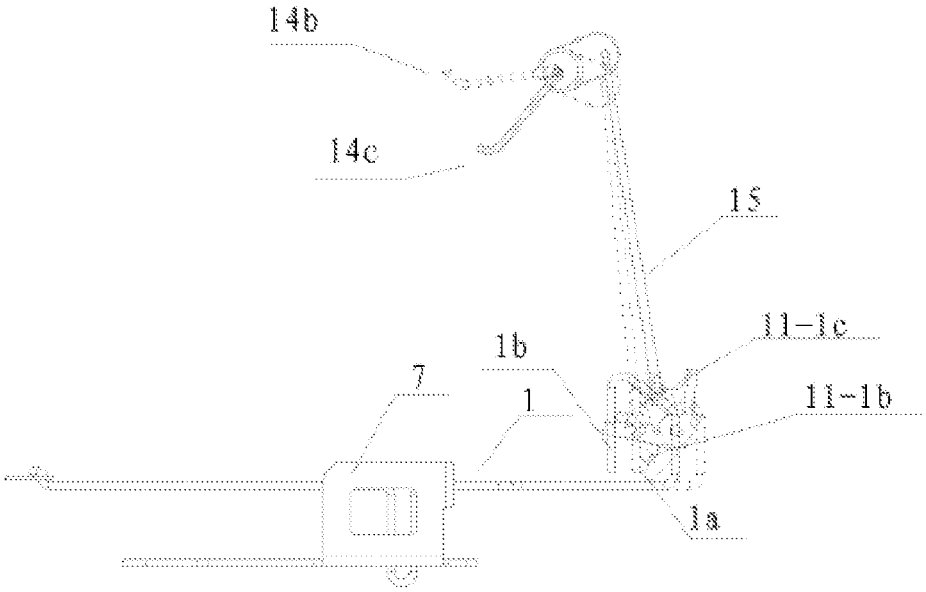
FIG. 8 is a schematic plan showing the position of the pull-rod when the choke valve is partially opened.

As shown in FIG. 8, as the temperature of the cylinder head (3) is gradually increased when the engine runs and due to the fact that the coil spring (5) is made of a double-layered metallic plate with the two layers having different thermal expansion coefficients, the coil spring (5) is rapidly heated and expanded causing the rotating shaft (4) to rotate and thereby driving the rotary arm (6) to swing, and with the rotary arm (6) pulling the pull-rod (1), the position-limiting end (11-1) of the choke valve shaft (11) is located close to the first position-limiting rod (1-*a*) on the pull-rod (1), and when the position-limiting end (11-1) of the choke valve shaft (11) has gradually rotated to 11-1*c*, the choke valve is fully opened. At this time, the choke block (14) is shifted to 14*c*, and the first position-limiting rod (1-*a*) is shifted to 1*b*.

Figure 9:
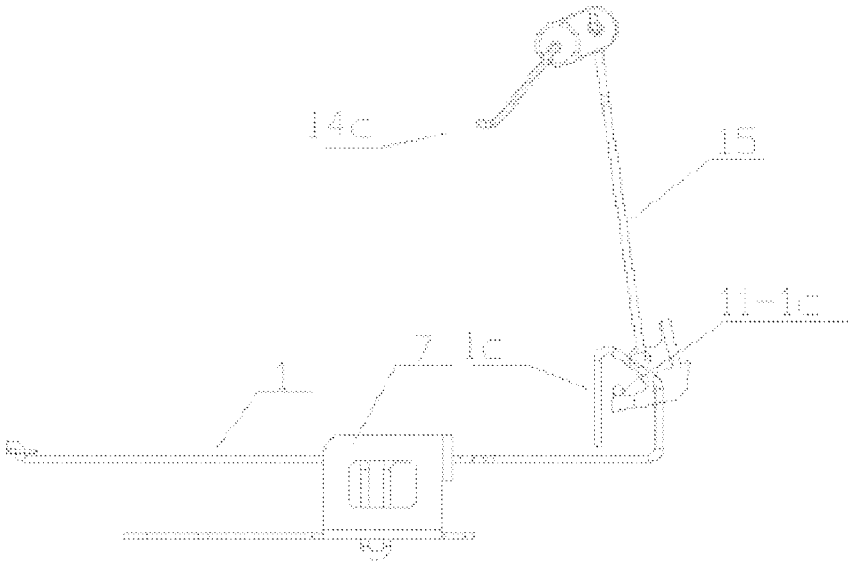
FIG. 9 is schematic plan showing the position of the pull-rod when the choke valve is fully opened.

As shown in FIG. 9, after the choke valve has fully opened, the choke block (14) and the choke valve shaft (11) will no longer rotate. As the temperature continues to rise, the rotary arm (6) continues to rotate and the pull-rod (1) is driven to continue to move, and when the pull-rod (1) is moved to the extreme left side 1*e* of the straight slot (9) (as shown in FIG. 10), the pull-rod (1) will be blocked by the straight slot (9) and will no longer move, and the rotary arm (6) also will not rotate, during which time the first position-limiting rod (1-*a*) of the pull-rod is located at 1*c*, that is to say when the first position-limiting rod (1-*a*) of the pull-rod is at the utmost left position, a clearance is kept between the first position-limiting rod (1-*a*) of the pull-rod and the position 11-1*c* at which the choke valve shaft (11) is located, and it is thus ensured that the pull-rod (1) does not limit the full opening of the choke valve shaft (11).

When the above processes of cold start have been completed, the choke valve undergoes an automatic process from being closed to being fully opened. After shutdown of the engine, as the temperature decreases gradually the rotary arm (6), the pull-rod (1), the choke valve shaft (11) and the choke block (14) gradually return to their respective original positions when the engine is cold.

Figure 11:
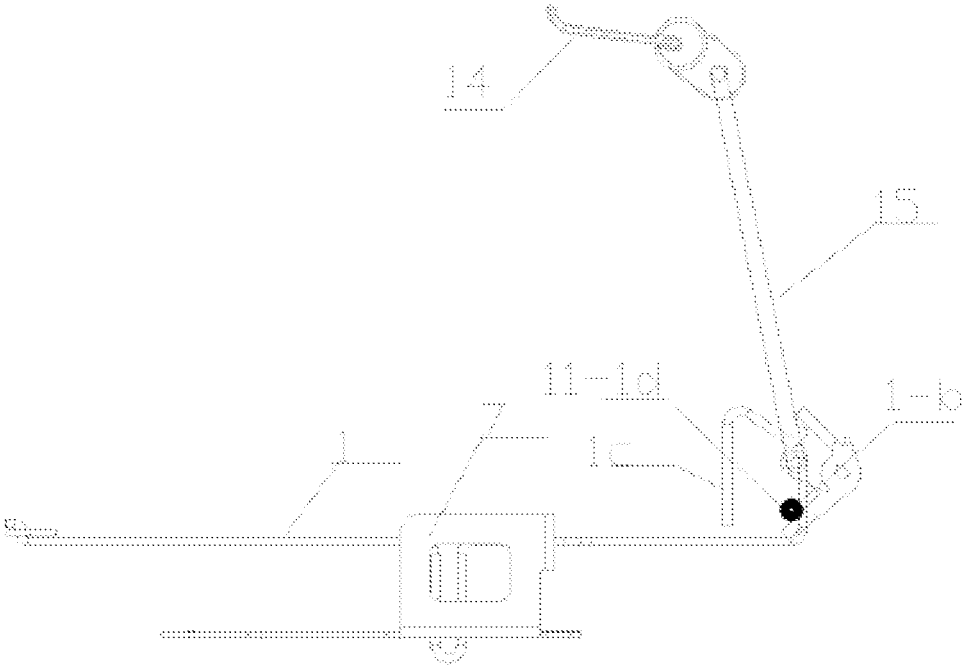
FIG. 11 is schematic plan showing the position of the pull-rod when the engine is warm started.

As shown in FIG. 11, after engine shutdown following a warm start, the temperature is relatively high and the pull-rod (1) has not returned and is still at 1*c*, and the position-limiting end (11-1) of the choke valve shaft will be blocked by the second position-limiting rod (I-b) of the pull-rod (1) when returning, such that the choke valve (11) cannot be fully closed; and when the engine is warm started, more air is allowed to enter the combustion chamber, thus preventing over-concentration of mixed gas during startup and the emergence of any jerking phenomenon.

When the engine is warm started after engine shutdown, the choke valve shaft (11) will be blocked by the second position-limiting rod (I-b) at location "b" of the pull-rod when returning such that the choke valve cannot be fully closed, and more fresh air is allowed to enter the combustion chamber. When immediate engine startup is not required, once the engine has cooled down the coil spring (5) automatically returns and simultaneously causes the rotary arm (6) to pull the pull-rod (1) to return causing the choke valve shaft (11) to turn around, and the choke valve becomes fully closed.

The temperature control assembly of the above embodiment may be fixed on a muffler and control the extent of opening of the choke valve through the temperature changes of the muffler.

The invention claimed is:

1. An automatic control apparatus for a carburetor choke valve, wherein the apparatus comprises a temperature control assembly, a pull-rod including a first position-limiting rod and a second position-limiting rod, a throttle control lever and a choke block, wherein the temperature control assembly is disposed on a cylinder head by means of a bracket, with the bracket being provided with a rotating shaft and a coil spring connected to the rotating shaft, wherein the rotating shaft is connected to one end of the pull-rod via a rotary arm, wherein another end of the pull-rod is located at a choke valve shaft, and one end of the throttle control lever is connected to the choke block while another end thereof is connected to the choke valve shaft, wherein during a cold start, the choke block is opened driving the throttle control lever to pull the choke valve shaft, wherein when rotated through a certain angle, the choke valve shaft is blocked by the first position-limiting rod at location "a" of the pull-rod such that the choke valve and the choke block cannot be fully opened, wherein during a warm start, the choke valve shaft is blocked by the second position-limiting rod at location "b" of the pull-rod when returning such that the choke valve cannot be fully closed, and wherein one end of the pull-rod disposed at the choke valve shaft forms a P or F shape, the choke valve shaft having a position-limiting end located between the first position-limiting rod and the second position-limiting rod of the pull-rod.

2. The automatic control apparatus for a carburetor choke valve as defined in claim 1, wherein the cylinder head has a retaining bracket disposed thereon to limit the movement distance and direction of the pull-rod, and wherein the retaining bracket limits the position and prevents the rotation of the pull-rod by means of a circular hole and a straight slot thereof.

3. The automatic control apparatus for a carburetor choke valve as defined in claim 1, wherein the coil spring is installed in a slot disposed on the bracket, one end of the coil spring being fixed to a positioning pin.

4. The automatic control apparatus for a carburetor choke valve as defined in claim 3, wherein the temperature control assembly is disposed behind a thermal insulation pad.

5. The automatic control apparatus for a carburetor choke valve as defined in claim 2, wherein the straight slot is located at the bottom of the retaining bracket, wherein the axis of the circular hole and that of the straight slot are coplanar, and the circular hole is located above the straight slot, and wherein the pull-rod has a U-shaped bend formed at the central portion thereof with the lower end of the U-shaped bend extending into the straight slot and the horizontal portion of the pull-rod penetrating through the circular hole.

6. The automatic control apparatus for a carburetor choke valve as defined in claim 1, wherein a clearance is kept between the first position-limiting rod and a position-limiting end of the choke valve shaft when the first position-limiting rod is at the utmost left position.

7. An automatic control apparatus for a carburetor choke valve, wherein the apparatus comprises a temperature control assembly, a pull-rod including a first position-limiting rod and a second position-limiting rod, a throttle control lever and a choke block, wherein the temperature control assembly is disposed on a cylinder head by means of a bracket, with the bracket being provided with a rotating shaft and a coil spring connected to the rotating shaft, wherein the rotating shaft is connected to one end of the pull-rod via a rotary arm, wherein another end of the pull-rod is located at a choke valve shaft, and one end of the throttle control lever is connected to the choke block while another end thereof is connected to the choke valve shaft, wherein during a cold start, the choke block is opened driving the throttle control lever to pull the choke valve shaft, wherein when rotated through a certain angle, the choke valve shaft is blocked by the first position-limiting rod at location "a" of the pull-rod such that the choke valve and the choke block cannot be fully opened, wherein during a warm start, the choke valve shaft is blocked by the second position-limiting rod at location "b" of the pull-rod when returning such that the choke valve cannot be fully closed, wherein the cylinder head has a retaining bracket disposed thereon to limit the movement distance and direction of the pull-rod, and wherein the retaining bracket limits the position and prevents the rotation of the pull-rod by means of a circular hole and a straight slot thereof.

8. The automatic control apparatus for a carburetor choke valve as defined in claim 7, wherein the straight slot is located at the bottom of the retaining bracket, wherein the axis of the circular hole and that of the straight slot are coplanar, and the circular hole is located above the straight slot, and wherein the pull-rod has a U-shaped bend formed at the central portion thereof with the lower end of the U-shaped bend extending into the straight slot and the horizontal portion of the pull-rod penetrating through the circular hole.

9. The automatic control apparatus for a carburetor choke valve as defined in claim 7, wherein the coil spring is installed in a slot disposed on the bracket, one end of the coil spring being fixed to a positioning pin.

10. The automatic control apparatus for a carburetor choke valve as defined in claim 9, wherein the temperature control assembly is disposed behind a thermal insulation pad.

11. The automatic control apparatus for a carburetor choke valve as defined in claim 7, wherein one end of the pull-rod disposed at the choke valve shaft forms a P or F shape, the choke valve shaft having a position-limiting end located between the first position-limiting rod and the second position-limiting rod.

12. The automatic control apparatus for a carburetor choke valve as defined in claim 11, wherein a clearance is kept between the first position-limiting rod and a position-limiting end of the choke valve shaft when the first position-limiting rod is at the utmost left position.

13. An automatic control apparatus for a carburetor choke valve, wherein the apparatus comprises a temperature control assembly, a pull-rod including a first position-limiting rod and a second position-limiting rod, a throttle control lever and a choke block, wherein the temperature control assembly is disposed on a cylinder head by means of a bracket, with the bracket being provided with a rotating shaft and a coil spring connected to the rotating shaft, wherein the rotating shaft is connected to one end of the pull-rod via a rotary arm, wherein another end of the pull-rod is located at a choke valve shaft, and one end of the throttle control lever is connected to the choke block while another end thereof is connected to the choke valve shaft, wherein during a cold start, the choke block is opened driving the throttle control lever to pull the choke valve shaft, wherein when rotated through a certain angle, the choke valve shaft is blocked by the first position-limiting rod at location "a" of the pull-rod such that the choke valve and the choke block cannot be fully opened, wherein during a warm start, the choke valve shaft is blocked by the second position-limiting rod at location "b" of the pull-rod when returning such that the choke valve cannot be fully closed, wherein the coil spring is installed in a slot disposed on the bracket, one end of the coil spring being fixed to a positioning pin, and wherein the temperature control assembly is disposed behind a thermal insulation pad.

14. The automatic control apparatus for a carburetor choke valve as defined in claim 13, wherein the cylinder head has a retaining bracket disposed thereon to limit the movement distance and direction of the pull-rod, and wherein the retaining bracket limits the position and prevents the rotation of the pull-rod by means of a circular hole and a straight slot thereof.

15. The automatic control apparatus for a carburetor choke valve as defined in claim 14, wherein the straight slot is located at the bottom of the retaining bracket, wherein the axis of the circular hole and that of the straight slot are coplanar, and the circular hole is located above the straight slot, and wherein the pull-rod has a U-shaped bend formed at the central portion thereof with the lower end of the U-shaped bend extending into the straight slot and the horizontal portion of the pull-rod penetrating through the circular hole.

16. The automatic control apparatus for a carburetor choke valve as defined in claim 13, wherein one end of the pull-rod disposed at the choke valve shaft forms a P or F shape, the choke valve shaft having a position-limiting end located between the first position-limiting rod and the second position-limiting rod.

17. The automatic control apparatus for a carburetor choke valve as defined in claim 16, wherein a clearance is kept between the first position-limiting rod and a position-limiting end of the choke valve shaft when the first position-limiting rod is at the utmost left position.

* * * * *